US006830400B2

(12) United States Patent
Yerg nson

(10) Patent No.: US 6,830,400 B2
(45) **Date of Patent: *Dec. 14, 2004**

(54) METHODS AND SYSTEMS FOR A MULTI-POSITION PRINT MEDIA FEED-TRAY

(75) Inventor: Robin P. Yerg nson, Eagle, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/650,952

(22) Filed: Aug. 28, 2003

(65) Prior Publication Data

US 2004/0037607 A1 Feb. 26, 2004

Related U.S. Application Data

(63) Continuation of application No. 09/957,818, filed on Sep. 20, 2001, now Pat. No. 6,641,318.

(51) Int. Cl.[7] ..... B41J 29/02

(52) U.S. Cl. ..... 400/693; 400/647; 400/646

(58) Field of Search ..... 400/625, 627, 400/613, 628, 646, 647, 694, 691, 693; 271/9.04, 9.06, 9.08, 256.04, 292, 145, 162

(56) References Cited

U.S. PATENT DOCUMENTS

| | | | | |
|---|---|---|---|---|
| 4,371,276 | A | | 2/1983 | Mitrovich et al. |
| 4,814,798 | A | | 3/1989 | Fukae et al. |
| 4,903,139 | A | | 2/1990 | Minter |
| 5,135,321 | A | | 8/1992 | Olsen et al. |
| 5,324,018 | A | | 6/1994 | Miura et al. |
| 5,387,043 | A | | 2/1995 | Fujioka et al. |
| 5,713,568 | A | | 2/1998 | Tamehira |
| 5,975,515 | A | | 11/1999 | Capri et al. |
| 6,179,280 | B1 | | 1/2001 | Coppolo et al. |
| 6,264,386 | B1 | | 7/2001 | Sugahara |
| 6,330,423 | B1 | | 12/2001 | Kitazawa |
| 6,386,663 | B1 | | 5/2002 | Olson |
| 6,428,000 | B1 | | 8/2002 | Hara et al. |
| 6,641,318 | B2 | * | 11/2003 | Yergenson ..... 400/625 |
| 2001/0053304 | A1 | | 12/2001 | Noda |

FOREIGN PATENT DOCUMENTS

| | | | | |
|---|---|---|---|---|
| JP | 06009066 A | * | 1/1994 | ..... B65H/1/04 |
| JP | 10017181 A | | 1/1998 | |
| JP | 10291694 A | | 11/1998 | |
| JP | 2000095370 | | 4/2000 | |
| JP | 2001-191607 | | 10/2000 | |
| JP | 2000-289909 | | 7/2001 | |
| JP | 2002-096945 | | 4/2002 | |
| JP | 2002187629 A | * | 7/2002 | ..... B65H/1/04 |

OTHER PUBLICATIONS

Machine translation of JP 06009066 to Isobe from Japanese Patent Office Website.*

Machine translation of JP 2001191607 from Japanese Patent Office website.

* cited by examiner

*Primary Examiner*—Daniel J. Colilla

(57) ABSTRACT

Methods and systems for a multi-position print media feed tray are described. In one embodiment, a print media feed-tray comprises a structure for holding print media. The print media feed-tray further comprises a coupling device for orienting the structure relative to a printing device. The coupling device can be capable of orienting the structure in at least two positions from which print media can be received by the printing device from the structure.

13 Claims, 6 Drawing Sheets

METHODS AND SYSTEMS FOR A MULTI-POSITION PRINT MEDIA FEED-TRAY

PRIORITY

This patent application is a continuation claiming priority from a patent application having Ser. No. 09/957,818 titled "Methods and Systems for a Multi-Position Print Media Feed-Tray" filed Sep. 20, 2001, and issued as U.S. Pat. No. 6,641,318.

TECHNICAL FIELD

This invention pertains to printers and printer systems, and, more particularly, to print media feed-trays.

BACKGROUND

Printing devices have become ubiquitous in society. These devices provide conveniences that were unfathomable only a short time ago. A user can now take a picture with a digital camera and within seconds have a photo quality print in hand.

These printing devices are used in very diverse environments—from large offices to the home den. However, across the board, one commonality exists, space is nearly always at a premium. In the home environment, a printer may share space on a desk with a computer, a monitor, a phone, a scanner, and speakers, etc. Thus, consumers desire a printer that requires a minimal amount of space or footprint. Additionally, a product's shape can affect its success in the marketplace. A device with parts that extend out from the main body of the device not only requires a larger footprint, but also is more likely to get bumped and broken. For example, a printer with a print media feed-tray that extends a relatively large distance from the main body of the printer can be susceptible to accidentally getting bumped. This can diminish customer satisfaction with the product. Yet, the consumer places increasing demands on the performance of these products, requiring that the products print on a wide variety of types and sizes of print media.

Accordingly, this invention arose out of concerns associated with providing a printer that minimizes the required footprint while maximizing the ability to handle various types and shapes of print media.

SUMMARY

In one embodiment, a print media feed-tray comprises a structure for holding print media. The embodiment further comprises a coupling device for orienting the structure relative to a printing device. The coupling device can be capable of orienting the structure in at least two positions from which print media can be received by the printing device from the structure.

In a further embodiment, a printing device comprises a housing and a print media feed-tray. The print media feed-tray can be oriented in multiple orientations relative to the housing. At least two of the multiple orientations can allow print media to be fed into the printing device.

A further embodiment comprises a method of providing print media to a printing device. The method provides a structure for holding print media, and adjustably orients the structure in relation to a printing device so that print media can be received by the printing device from the structure from multiple orientations.

BRIEF DESCRIPTION OF THE DRAWINGS

The same numbers are used throughout the drawings to reference like features and components.

DETAILED DESCRIPTION

Overview

The inventive techniques and systems relate to print media handling devices. Common examples of print media handling devices include, but are not limited to printers and other printing devices. The embodiments described below pertain to a print media feed-tray. Further embodiments permit a print media feed-tray to be adjustably oriented in relation to a printer's housing. Certain types of print media can require a specific orientation of the feed-tray in relation to the housing in order to satisfactorily feed into the printer. Some orientations of the feed-tray can permit more satisfactory feeding of certain print media than others, however, those orientations may cause the printer to have a larger footprint. The ability to adjust the orientation can allow the feed-tray to be oriented to satisfactorily feed a selected print media. The selected orientation can be one that satisfactorily feeds the print media while causing a smaller footprint than other possible orientations. A user can manually adjust the orientation of the feed-tray. Alternatively, a processor can cause the adjustment to be made. Additionally, upon completion of printing, the feed tray can be readjusted to an orientation that further reduces the footprint of the printer or printing device.

The various components described below may not be illustrated accurately as far as their size is concerned. Rather, the included figures are intended as diagrammatic representations to illustrate to the reader various inventive principles that are described herein.

Exemplary Printer System

Figure 1:
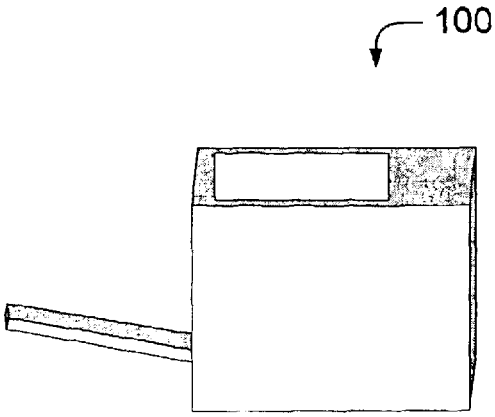
FIG. 1 is a side plan view of an exemplary printing device in accordance with one embodiment.

FIG. 1 depicts an exemplary printer 100. It will be appreciated and understood that the illustrated printer constitutes but one exemplary printing device and is not intended to be limiting in any way. Accordingly, other printing devices can be used in connection with the inventive techniques and systems described herein. Printing devices can include, but are not limited to, FAX machines, copiers, and printers. These other printing devices can have components that are different from those described below.

Figure 2:
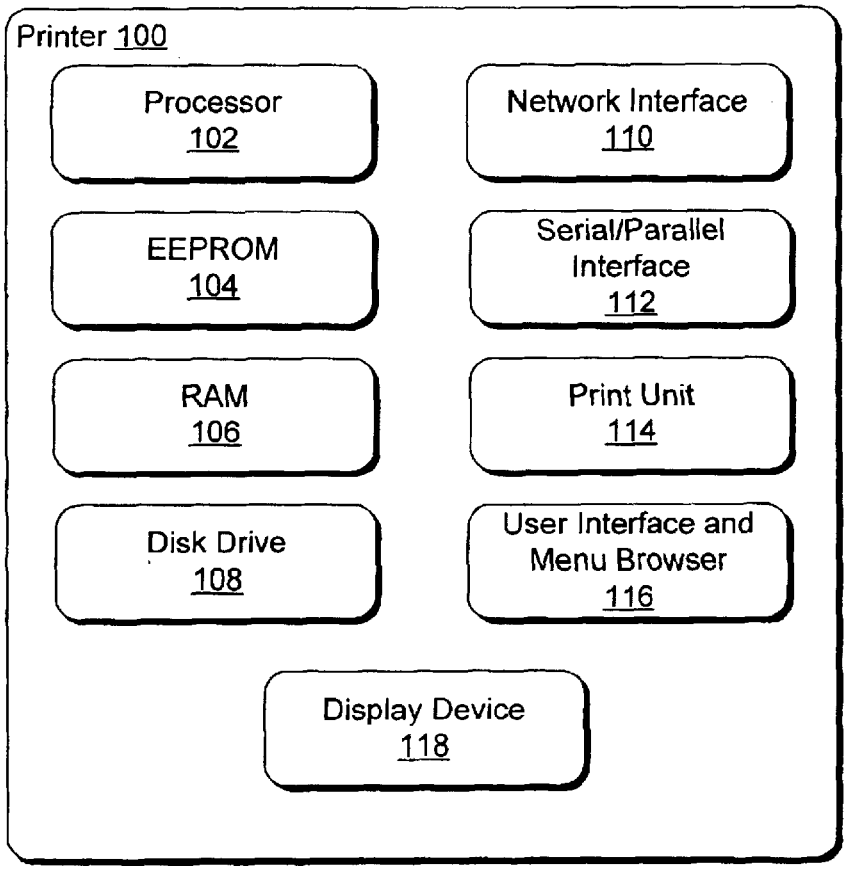
FIG. 2 is a block diagram of an exemplary printing device in accordance with one embodiment.

FIG. 2 is a block diagram showing exemplary components of a printing device in the form of a printer 100 in accordance with one embodiment. Printer 100 includes a processor 102, an electrically erasable programmable read-only memory (EEPROM) 104, and a random access memory (RAM) 106. Processor 102 processes various instructions necessary to operate the printer 100 and communicate with other devices. EEPROM 104 and RAM 106 store various information such as configuration information, fonts, templates, data being printed, and menu structure information. Although not shown in FIG. 1, a particular printer may also contain a ROM (non-erasable) in place of or in addition to EEPROM 104. Furthermore, a printer may alternatively contain a flash memory device in place of or in addition to EEPROM 104.

Printer 100 can also include a disk drive 108, a network interface 110, and a serial/parallel interface 112. Disk drive 108 provides additional storage for data being printed or other information used by the printer 100. Although both RAM 106 and disk drive 108 are illustrated in FIG. 2, a particular printer can contain either RAM 106 or disk drive 108, depending on the storage needs of the printer. For example, an inexpensive printer may contain a small amount of RAM 106 and no disk drive 108, thereby reducing the manufacturing cost of the printer. Network interface 110 provides a connection between printer 100 and a data communication network. Network interface 110 allows devices coupled to a common data communication network to send print jobs, menu data, and other information to printer 100 via the network. Similarly, serial/parallel interface 112 provides a data communication path directly between printer 100 and another device, such as a workstation, server, or other computing device. Although the printer 100 shown in FIG. 2 has two interfaces (network interface 110 and serial/parallel interface 112), a particular printer may only contain one interface.

Printer 100 also includes a print unit 114 that includes mechanisms that are arranged to selectively apply ink (e.g., liquid ink, toner, etc.) to a print media (e.g., paper, plastic, fabric, etc.) in accordance with print data within a print job. Thus, for example, print unit 114 can include a conventional laser printing mechanism that selectively causes toner to be applied to an intermediate surface of a drum or belt. The intermediate surface can then be brought within close proximity of a print media in a manner that causes the toner to be transferred to the print media in a controlled fashion. The toner on the print media can then be more permanently fixed to the print media, for example, by selectively applying thermal energy to the toner. Print unit 114 can also be configured to support duplex printing, for example, by selectively flipping or turning the print media as required to print on both sides. Those skilled in the art will recognize that there are many different types of print units available, and that for the purposes of the present embodiments print unit 114 can include any of these various types.

Printer 100 also contains a user interface/menu browser 116 and a display panel 118. User interface/menu browser 116 allows the user of the printer to navigate the printer's menu structure. User interface 116 may be a series of buttons, switches or other indicators that are manipulated by the user of the printer. The printer display or display panel 118 is a graphical display that provides information regarding the status of the printer and the current options available through the menu structure.

In the discussion above and below, certain aspects of the described embodiments can be implemented in terms of software instructions that reside on a computer-readable media. These instructions, when executed by a computer or processor, are configured to implement a designed functionality. This functionality will be described in this document in flow chart form.

Exemplary Host Computer

Figure 3:
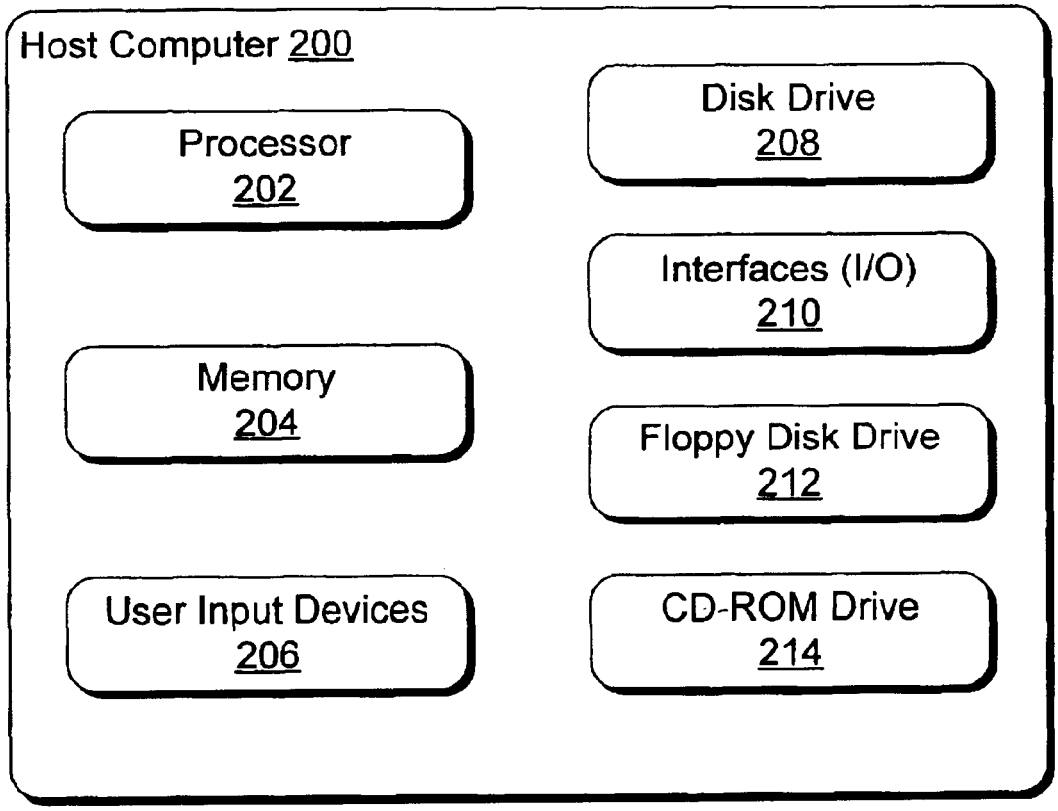
FIG. 3 is a block diagram of an exemplary computing device in accordance with one embodiment.

For purposes of understanding various structures associated with an exemplary host computer, consider FIG. 3.

FIG. 3 is a block diagram showing exemplary components of a host computer 200. Host computer 200 includes a processor 202, a memory 204 (such as ROM and RAM), user input devices 206, a disk drive 208, interfaces 210 for inputting and outputting data, a floppy disk drive 212, and a CD-ROM drive 214. Processor 202 performs various instructions to control the operation of computer 200. Memory 204, disk drive 208, and floppy disk drive 212, and CD-ROM drive 214 provide data storage mechanisms. User input devices 206 include a keyboard, mouse, pointing device, or other mechanism for inputting information to computer 200. Interfaces 210 provide a mechanism for computer 200 to communicate with other devices.

Exemplary Embodiment

FIGS. 4*a*, 4*c*, 4*e*, and 4*g* show a printer 100 having a housing 300 and a structure for holding print media. In this illustrated embodiment, the structure comprises a print media feed-tray 302 (hereinafter "feed-tray"). Other satisfactory structures are known in the printer art. FIGS. 4*a*, 4*c*, 4*e*, and 4*g*, further show the feed-tray oriented at various angles in relation to the housing. The housing 300 and feed-tray 302 are commonly comprised of plastic, though many other suitable materials exist. The feed-tray can be configurable to hold many forms of print media including, but not limited to, various weights and sizes of sheets of paper and various envelopes.

Figure 4A:
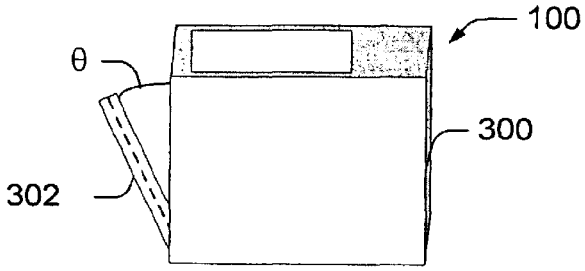
FIG. 4*a* is a side plan view of an exemplary printing device in accordance with one embodiment.
Figure 4B:
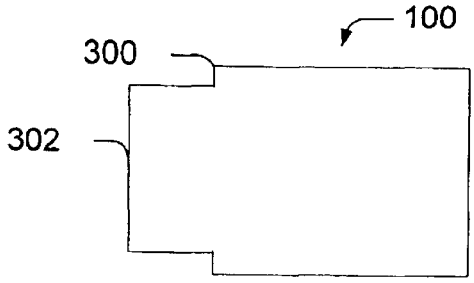
FIG. 4*b* is a top plan view of the printing device depicted in FIG. 4*a*.
Figure 4C:
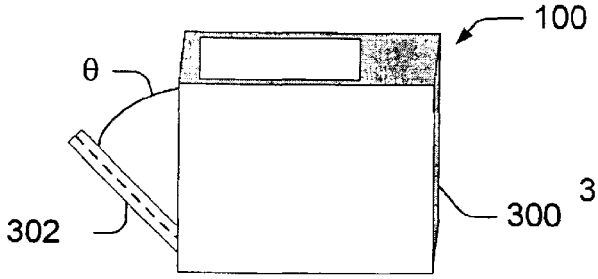
FIG. 4*c* is a side plan view of an exemplary printing device in accordance with one embodiment.
Figure 4D:
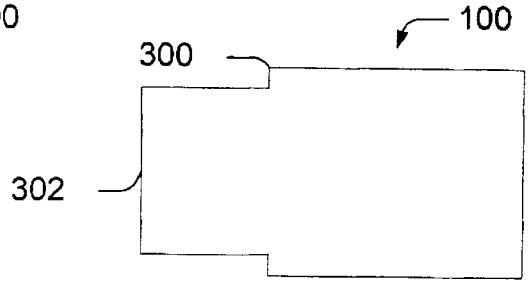
FIG. 4*d* is a top plan view of the printing device depicted in FIG. 4*c*.
Figure 4E:
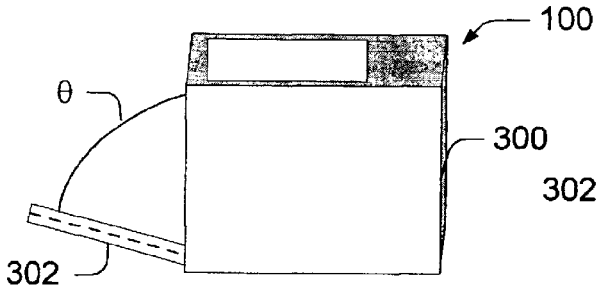
FIG. 4*e* is a side plan view of an exemplary printing device in accordance with one embodiment.

In this embodiment, print media is positioned in the feed-tray so that it can be fed into or received by the printer. Some types of print media can feed better at some feed-tray orientations than other orientations. For example, heavy-weight paper and envelopes can be less flexible than standard printer paper. This inflexibility can cause them to jam when fed into the printer at an orientation that requires them to bend excessively. Different orientations can be seen by comparing FIGS. 4*a*, 4*c* and 4*e*. As depicted in FIG. 4*a*, the feed-tray 302 is oriented at an angle θ relative to the housing 300. As depicted in FIG. 4*c*, the angle θ is greater than in FIG. 4*a*. The greater angle θ can cause the print media to bend less as it is fed into the printer than the angle shown in FIG. 4*a*. Likewise, FIG. 4*e* shows an angle θ that is even greater than shown in either FIG. 4*a* or 4*c*. This orientation can cause even less bending of the print media, and can thus allow more types of print media to be fed satisfactorily.

Figure 4F:
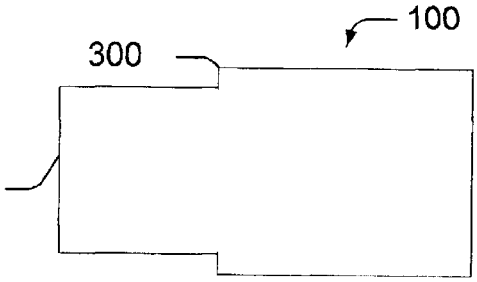
FIG. 4*f* is a top plan view of the printing device depicted in FIG. 4*e*.

As the angle θ of the feed-tray relative to the housing approaches or is equal to 90 degrees, it can allow an increased ability to feed various types of print media. However, as shown by comparing FIGS. 4*b*, 4*d*, and 4*f*, an increased angle has another consequence. FIG. 4*b* represents a footprint of FIG. 4*a*. Likewise, FIG. 4*d* represents the footprint of FIG. 4*c* and FIG. 4*f* represents 4*e*. The footprint is defined by the dimensions of the printer when viewed from above. It can be seen from these Figs. that increasing the angle θ of the feed-tray relative to the housing toward 90 degrees causes a larger associated footprint. A larger footprint requires more valuable desk space, and further increases the chance of accidental damage to the printer. In recognition of this fact, some existing printers utilize a fixed print angle similar to that depicted in FIG. 4*c* as an attempt to balance the printer's footprint with the ability to satisfactorily feed print media. However, by using a fixed position at an acute angle the printers do not satisfactorily feed all types of print media.

The feed-tray 302 depicted in FIGS. 4*a*, 4*c*, 4*e*, and 4*g* can be adjustably oriented relative to the housing 300. This can allow the feed-tray to be oriented in a near limitless number of orientations that can allow print media to be received by the printer from the feed-tray. For feeding flexible print media such as standard weight paper, the feed-tray can be oriented similar to that depicted in FIG. 4*a*. This orientation can cause the printer to have a relatively small footprint as represented by FIG. 4*b*. For print media that is more difficult to feed, the feed-tray can be adjusted to an orientation similar to that shown in FIG. 4*c*. This orientation can increase the ability to feed print media, but causes a somewhat larger footprint as represented by FIG. 4*d*. Further, the feed-tray can be adjusted to an orientation similar to that shown in FIG. 4*e* with the resultant greater ability to feed and increased footprint as depicted by FIG. 4*f*.

Figure 4G:
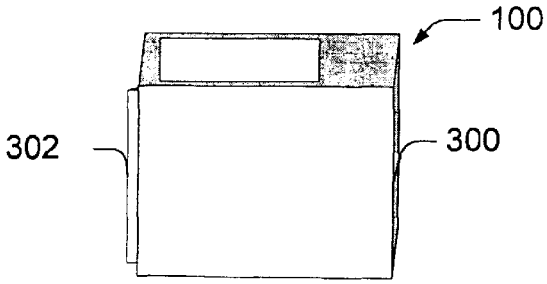
FIG. 4*g* is a side plan view of an exemplary printing device in accordance with one embodiment.
Figure 4H:
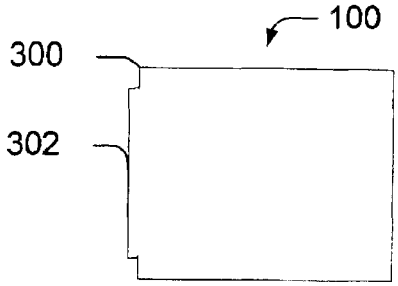
FIG. 4*h* is a top plan view of the printing device depicted in FIG. 4*g*.

As shown in FIG. 4*g*, some embodiments can allow the feed-tray 302 to further be oriented in a storage position relative to the housing. While this configuration minimizes the printer's footprint, printers often are not able to satisfactorily receive or feed print media from a feed-tray in a storage position. The storage position can be used instead to protect the feed-tray from accidental damage, and minimize space requirements of the printer as can be seen from FIG. 4*h*. Some existing printers can be converted from a storage position similar to FIG. 4*g* to a single printing position similar to FIG. 4*e*. In these existing printers, the feed-tray can be protected in the storage position. However, in order to print on any type of print media, the feed-tray must be opened to the orientation that requires a very large footprint and exposes the printer to an increased chance of accidental damage. Conversely, the present embodiments can allow the orientation to be adjusted so that satisfactory feeding of the desired print media can be achieved at a minimum relative angle and hence diminished footprint.

Figure 5:
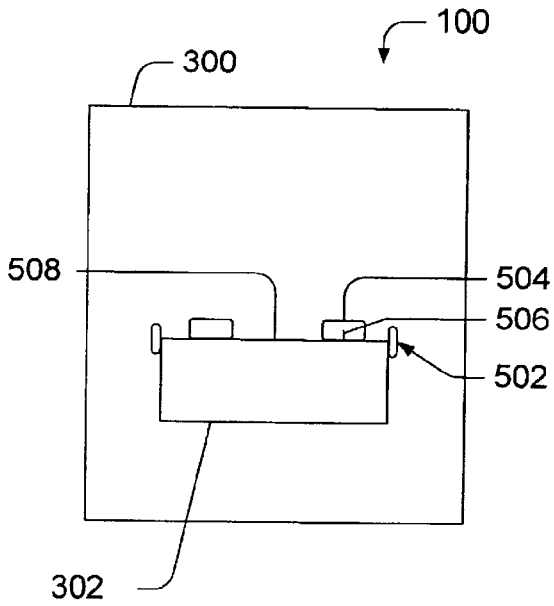
FIG. 5 is a front plan view of an exemplary printing device in accordance with one embodiment.

As with FIG. 4, FIG. 5 shows the printer 100 having a housing 300 and a feed-tray 302. FIG. 5 further shows the feed-tray 302 oriented at an angle θ of approximately 110 degrees in relation to the housing 300. This orientation can be achieved by a coupling device 502 (coupling devices are described in more detail below in relation to FIG. 6*a*). FIG. 5 further shows a print media feeding mechanism 504. Various embodiments can have at least one print media feeding mechanism. As shown in FIG. 5, the feeding mechanism 504 can comprise a pick roller. The feeding mechanism can be generally cylindrical as shown in FIG. 5. The cylindrical feeding mechanism 504 can have a radius 506 configured to contact print media upon feeding. Some embodiments can allow the feeding mechanism to maintain a constant angle of attack relative to a print media positioned in the feed-tray. This can be seen from FIG. 5, where the axis of rotation 508 of the feed-tray 302 runs along the radius 506 of the feeding mechanism 504.

Figure 6A:
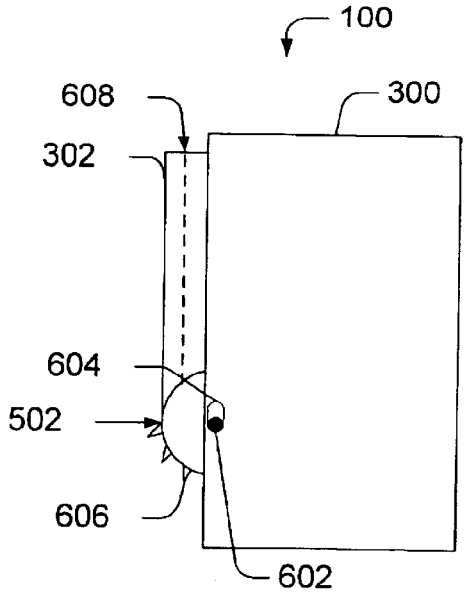
FIG. 6*a* is a side plan view of an exemplary printing device in accordance with one embodiment.
Figure 6B:
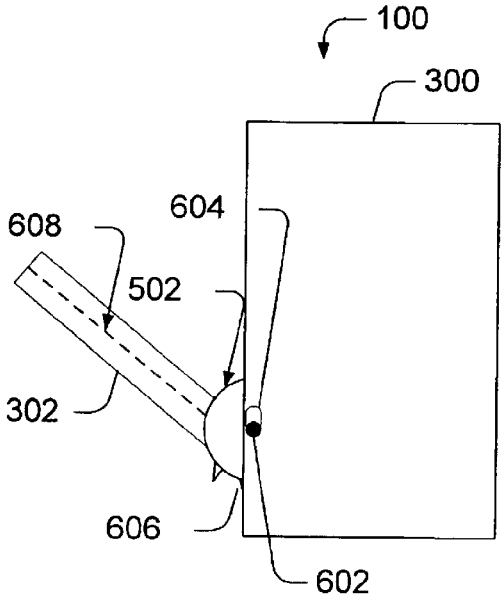
FIG. 6*b* is a side plan view of an exemplary printing device in accordance with one embodiment.
Figure 6C:
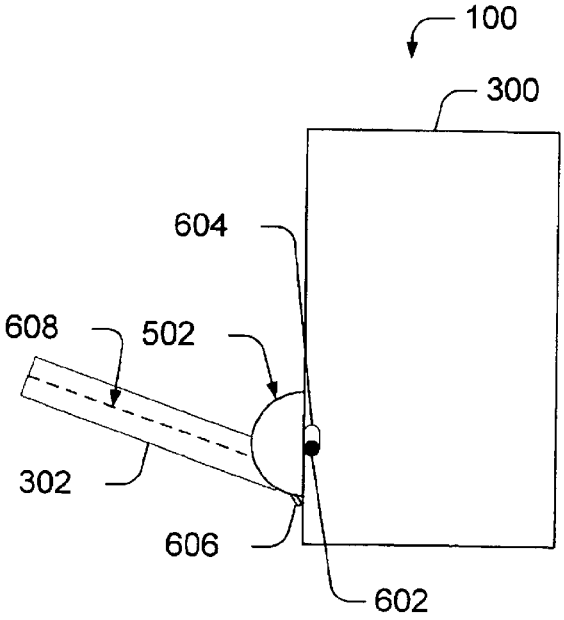
FIG. 6*c* is a side plan view of an exemplary printing device in accordance with one embodiment.

FIG. 6*a* is an exemplary embodiment showing one possible configuration for the coupling device 502. The coupling device can comprise a hinge, or other adjustable fastening device. The coupling device can be capable of orienting the feed-tray 302 in at least two orientations that allow print media to be received or fed by the printer 100. Exemplary orientations are shown in FIGS. 6*b* and 6*c*. Although the orientations shown in FIGS. 6*b* and 6*c* have an angle less than 90 degrees, satisfactory embodiments can have an angle of 90 or more degrees. Some embodiments can also orient the feed-tray in a storage position in addition to the at least two feeding positions. Examples of the feed-tray oriented in a storage position are shown in FIGS. 4*g* and 6*a*.

FIGS. 6*a*–6*c* show printer 100. In this embodiment, the feed-tray is oriented relative to the housing by the coupling device 502. The coupling device is adjustably fastened to the housing 300 by hinge pin 602 receivably positioned by a slot 604 in the housing 300.

The coupling device 502 further has multiple protrusions 606 that can hold the feed-tray in a desired orientation relative to the housing. A user can adjust the orientation of the feed-tray by lifting upwardly on the feed-tray so that the hinge-pin 602 slides up in the slot 604. This can disengage protrusion 606 and the user can then adjust the orientation. The user can then allow the feed-tray to slide downwardly, thus reengaging a protrusion 606. Such manipulation can allow a user to adjust the orientation as shown in FIGS. 6*a*–6*c*. The user can make such adjustment based upon whether such an orientation can satisfactorily feed a chosen print media, the size of the footprint associated with that orientation, and the space availability among others.

FIGS. 6*a*–6*c* show the feed-tray 302 having a generally planar surface 608 upon which print media is supported. The feed-tray can rotate on an axis that is generally parallel to the planar surface 608 of the feed-tray. For example, in FIGS. 6*a*–6*c*, the axis of rotation can be on the hinge pin 602. Orienting along the axis of rotation can allow the pick roller 504 to contact print media located in the feed-tray 302 from at least two configurations.

Figure 7:
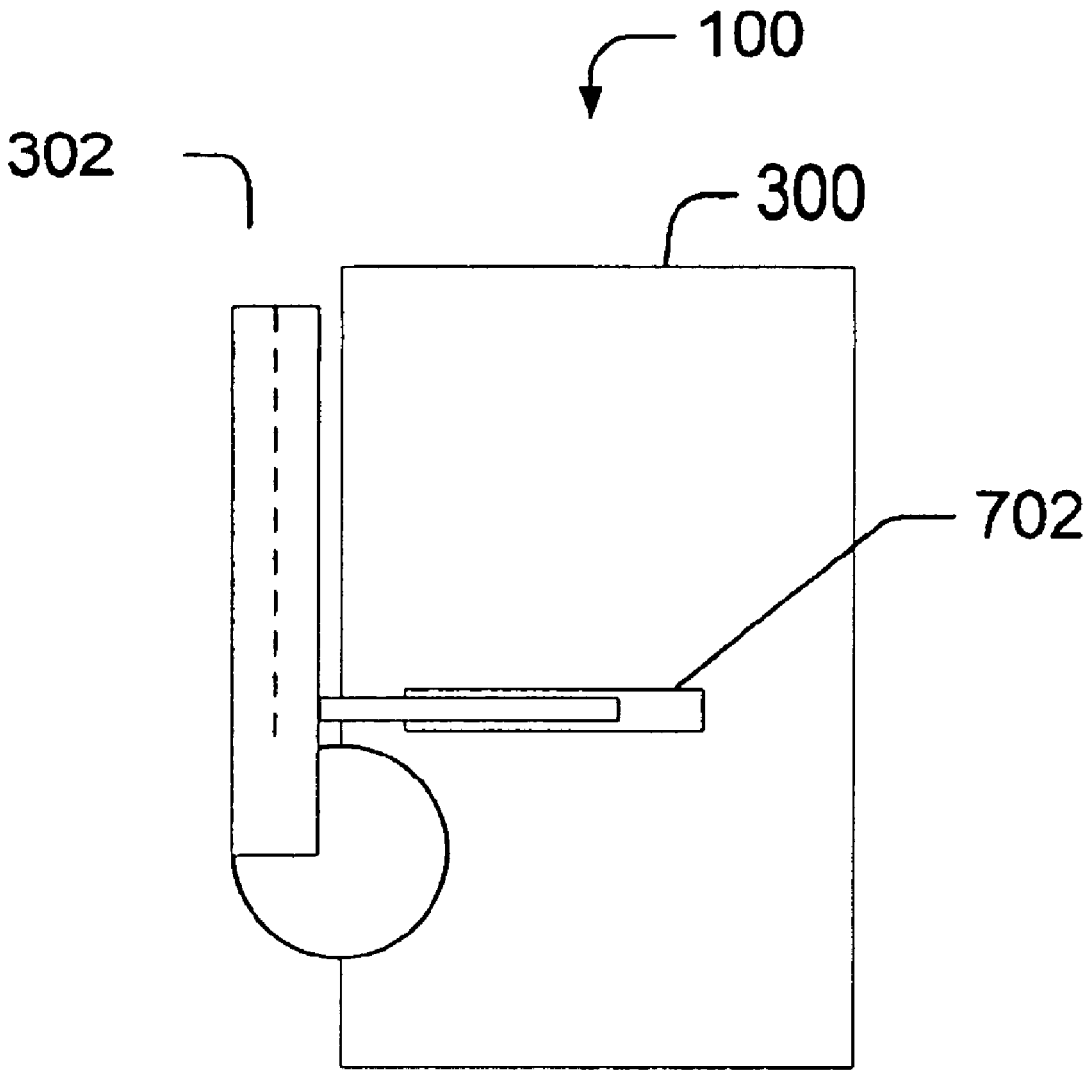
FIG. 7 is a side plan view of an exemplary printing device in accordance with one embodiment.

FIG. 7 shows another embodiment having a piston/cylinder assembly 702. One end of the assembly can be attached to the housing 300 and the opposite end to the feed-tray 302. Extending the piston can cause the orientation of the feed-tray relative to the housing to be adjusted. The position of the piston relative to the cylinder can be controlled by a gear assembly, or by electro-magnet among others.

FIG. 7 is an embodiment that can easily be controlled by a processor. The processor can comprise any suitable processor configurable to cause adjustment of the orientation of the feed-tray in relation to the housing. Satisfactory processors can include previously described processor 102, which is a component of the printer 100, or processor 202, which is a component of host computer 200 among others.

The processor can be controllably coupled with the assembly 702 to cause the orientation to be adjusted. The processor can cause the adjustment of the print media feed-tray to an orientation that will satisfactorily feed the selected print media while minimizing the footprint of the printing device. In one embodiment, the processor can be configured to automatically cause an adjustment of the orientation of the feed-tray based on the type of print media that will be employed for a given print job. In another embodiment, the processor can be coupled to sensors in the feed-tray that sense the type of print media that is in the feed-tray. The processor can use a lookup table to determine what orientation to adjust the feed-tray to, or alternatively, the processor can be programmed to adjust the feed-tray angle for a specific type of print media based on previous performance feeding the specific print media at various orientations. Upon completion of a print job, the processor can be further configured to cause the feed-tray to be adjusted to an orientation that minimizes the footprint.

The piston/cylinder assembly is but one way of adjustably orienting the feed-tray 302 with a structure or device that can be automatically controlled. Other satisfactory embodiments can include, but are not limited to, gear driven assemblies, rack and pinion assemblies, cam and follower assemblies, four bar linkage assemblies, and friction clutch assemblies.

Exemplary Method

Figure 8:
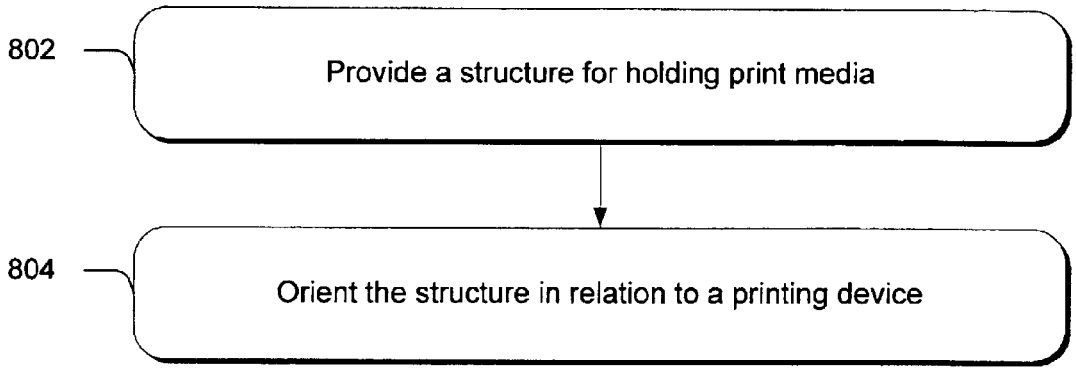
FIG. 8 is a flow chart showing steps in a method in accordance with one embodiment.

FIG. 8 is a flow chart depicting the steps in one exemplary embodiment.

The following method can be implemented on hardware, software, firmware or any combination thereof. Step 802 provides a structure for holding print media. A feed-tray 302, as described above, can comprise a satisfactory structure. Many other satisfactory structures can be utilized. For example, a length of metal wire can be configured to support the print media.

Step 804 adjustably orients the structure in relation to a printer. Individual orientations can allow different types of print media to be fed from the structure. Additionally, the structure can be oriented or positioned in a non-feeding storage orientation or position.

In one embodiment, the structure is adjustably oriented in an orientation that allows satisfactory feeding while minimizing the footprint. The orientation can be adjusted by a user or by a processor. This method can allow the printer to satisfactorily feed a desired print media while occupying the smallest possible footprint. Depending on the capabilities of a given printer the processor may use pre-established look-up tables to determine the orientation that satisfactorily prints a given print media while minimizing footprint, or the processor may incorporate previous performance to determine the optimum angle. Other satisfactory embodiments exist and can be recognized by one of skill in the art.

CONCLUSION

The multi-position feed-tray described above can allow a user to have a printer that does not occupy more space than is necessary for satisfactory feeding of a desired print media. Further, the system can be automated so that a processor adjusts the orientation based on a selected print media for a printing job. Upon completion of printing, the processor can readjust the feed-tray to minimize the footprint occupied by the printer.

Although the invention has been described in language specific to structural features and/or methodological steps, it is understood that the invention defined in the appended claims is not necessarily limited to the specific features or steps described. Rather, the specific features and steps are disclosed as preferred forms of implementing the claimed invention.

What is claimed is:

1. A printing device comprising:

a print media feed-tray capable of being oriented in multiple orientations relative to a housing of a printing device, wherein the orientations of the feed-tray cause the printing device to have various footprints, and wherein at least two of the orientations allow print media to be received by a print media feeding mechanism of the printing device; and, a processor for causing the print media feed-tray to be oriented in a selected one of the multiple orientations, at least in part, by assessing a look up table of predetermined orientations for a selected print media.

2. The printing device of claim 1, wherein one orientation of the multiple orientations of the print media feed-tray is a storage position which minimizes the footprint, and wherein the print media feed-tray is configured to hold print media in the storage position.

3. A printing device comprising:

a print media feed-tray capable of being oriented in multiple orientations relative to a housing of a printing device, wherein the orientations of the feed-tray cause the printing device to have various footprints, and wherein at least two of the orientations allow print media to be received by a print media feeding mechanism of the printing device; and, a processor for causing the print media feed-tray to be oriented in a selected one of the multiple orientations, at least in part, by accessing data derived from previous printing device performance at feeding a selected print media.

4. The printing device of claim 3, wherein one orientation of the multiple orientations of the print media feed-tray is a storage position which minimizes the footprint, and wherein the print media feed-tray is configured to hold print media in the storage position.

5. A method comprising:

selecting, based at least in part on a print media selected for a print job, a range of orientations for a print media feed-tray which will allow the print media to be received from the feed-tray for printing on a printing device; and, selecting, from the range of orientations, an orientation which provides the smallest footprint for the printing device, wherein the acts of selecting a range of orientations and selecting an orientation are accomplished by a processor.

6. The method of claim 5, wherein the act of selecting a range of orientations is based, at least in part, on accessing data derived from previous printing device performance at feeding a selected print media.

7. The method of claim 5, wherein the act of selecting a range of orientations is based, at least in part, by accessing a look up table of suitable orientations for feeding a selected print media.

8. The method of claim 5, wherein the processor is located on the printing device.

9. The method of claim 5, wherein the processor is located on a network device coupled to the printing device.

10. The method of claim 5, wherein the processor is located on a host computer coupled to the printing device.

11. A method comprising:

determining a type of print media positioned in a print media feed tray by sensing the type of print media;

transmitting signals representing the sensed type of media to a processor;

selecting, based at least in part on the determined type of print media, a range of angular orientations for the print media feed-tray which will allow the print media to be received from the feed-tray for printing on a printing device using the processor; and, selecting, from the range of orientations, an orientation which provides the smallest footprint for the printing device using the processor.

12. One or more computer-readable media having stored thereon computer executable instructions that, when executed by one or more processors, causes the one or more processors of a printing device to:

based at least in part on a print media selected for a print job, select a range of orientations for a print media feed-tray which allow the print media to be received from the tray for printing; and, select, from the range of orientations, an orientation which provides the smallest footprint for the printing device.

13. A printing device comprising:

a print media feed tray that can be oriented in at least two orientations that allow a print media to be received by a printing mechanism; and, a processor for controlling the orientation of the feed tray such that a footprint of the printing device is minimized.

* * * * *